US008720336B2

(12) United States Patent
Sato et al.

(10) Patent No.: US 8,720,336 B2
(45) Date of Patent: May 13, 2014

(54) PLATE FOR MAGNET CYLINDER

(75) Inventors: Mitsuhiko Sato, Yamagata (JP); Masahiko Takahashi, Yamagata (JP)

(73) Assignee: Komori Corporation, Tokyo (JP)

( * ) Notice: Subject to any disclaimer, the term of this patent is extended or adjusted under 35 U.S.C. 154(b) by 285 days.

(21) Appl. No.: 11/726,038

(22) Filed: Mar. 19, 2007

(65) Prior Publication Data

US 2007/0227379 A1 Oct. 4, 2007

(30) Foreign Application Priority Data

Apr. 3, 2006 (JP) ..... 2006-102548

(51) Int. Cl.
*B41F 27/00* (2006.01)

(52) U.S. Cl.
USPC ..... 101/389.1; 101/378; 101/383

(58) Field of Classification Search
USPC ..... 101/123, 378, 389, 389.1, 453, 383
See application file for complete search history.

(56) References Cited

U.S. PATENT DOCUMENTS

| | | | | | |
|---|---|---|---|---|---|
| 3,668,752 | A * | 6/1972 | Clifton et al. | 492/8 |
| 3,730,092 | A * | 5/1973 | Pickard et al. | 101/415.1 |
| 4,144,108 | A * | 3/1979 | Gidley et al. | 156/60 |
| 4,817,527 | A * | 4/1989 | Wouch et al. | 101/389.1 |
| 4,854,237 | A * | 8/1989 | Theilacker | 101/415.1 |
| 5,103,729 | A * | 4/1992 | Philpot | 101/415.1 |
| 5,216,953 | A * | 6/1993 | Hada | 101/375 |
| 5,476,039 | A * | 12/1995 | Hiruta et al. | 101/123 |
| 5,947,028 | A * | 9/1999 | Montgomery et al. | 101/477 |
| 6,062,140 | A * | 5/2000 | McEachern | 101/389.1 |
| 6,152,035 | A | 11/2000 | Scholtz et al. | |
| 6,397,747 | B1 * | 6/2002 | McEachern | 101/389.1 |
| 6,457,410 | B1 * | 10/2002 | Zerillo | 101/389.1 |
| 6,688,227 | B2 * | 2/2004 | Zerillo | 101/389.1 |
| 6,766,733 | B1 | 7/2004 | Collins | |
| 6,925,936 | B2 * | 8/2005 | Gottschalt et al. | 101/477 |
| 2004/0045467 | A1 * | 3/2004 | Nakagaki | 101/477 |
| 2005/0155505 | A1 * | 7/2005 | Jeurink | 101/375 |

FOREIGN PATENT DOCUMENTS

| | | | |
|---|---|---|---|
| EP | 1 391 320 | A1 | 2/2004 |
| FR | 2 559 426 | A1 | 8/1985 |
| JP | 53-6304 | | 1/1978 |
| JP | U58-76739 | | 5/1983 |
| JP | 07-164390 | A | 6/1995 |
| JP | 2001-253051 | | 9/2001 |
| JP | 2003-237018 | A | 8/2003 |

* cited by examiner

*Primary Examiner* — David Banh
(74) *Attorney, Agent, or Firm* — Blakely Sokoloff Taylor & Zafman

(57) ABSTRACT

A plate for a magnet cylinder includes a main body, a nonmagnetic portion, and a magnetic piece. The main body is formed of a flexible thin plate-like magnetic material to be magnetically mounted on the outer surface of a magnet cylinder. The nonmagnetic portion is projected from one end of the main body. The magnetic piece magnetically sandwiches the nonmagnetic portion against the outer surface of the magnet cylinder.

7 Claims, 12 Drawing Sheets

PLATE FOR MAGNET CYLINDER

BACKGROUND OF THE INVENTION

The present invention relates to a plate for a magnet cylinder to perform various types of processes, e.g., scoring, cut-marking, embossing, printing, coating, and the like on a sheet-like material or web.

As a conventional plate for a magnet cylinder, a plate magnetically mounted on the outer surface of the magnet cylinder which opposes an impression cylinder for conveying a sheet and has a magnet buried in its outer surface is proposed, as shown in Japanese Patent Laid-Open No. 2003-237018. Additionally, a plate which is positioned by a positioning jig with respect to the magnet cylinder, and magnetically mounted on the outer surface of the magnet cylinder is proposed, as shown in Japanese Patent Laid-Open No. 7-164390.

According to the above-described conventional plate, when discharging the plate from the magnetic cylinder, an operator holds the plate with his/her hand to remove it from the outer surface of the magnet cylinder. Hence, in order to hold the plate with his/her hand, he/she must execute an operation of removing the trailing edge of the plate from the outer surface of the magnet cylinder with a spatula or the like before removing the entire plate. In this case, in order to prevent a removed portion from being magnetically mounted on the outer surface of the magnet cylinder again, the operator must hold the removed portion with his/her hand. Hence, the operator must remove the plate with one hand while holding the removed portion with the other hand. This requires cumbersome operation and increases the load of the operator, thus posing a problem. Specifically, when the plate has a large outer size, the operator cannot remove the plate while holding the removed portion by himself/herself.

SUMMARY OF THE INVENTION

It is an object of the present invention to provide a plate for a magnet cylinder which can facilitate a plate discharging operation and shorten an operation time.

In order to achieve the above object according to an aspect of the present invention, there is provided a plate for a magnet cylinder comprising a main body which is formed of a flexible thin plate-like magnetic material to be magnetically mounted on an outer surface of a magnet cylinder, a nonmagnetic portion which is projected from one end of the main body, and a magnetic piece which magnetically sandwiches the nonmagnetic portion against the outer surface of the magnet cylinder.

DESCRIPTION OF THE PREFERRED EMBODIMENTS

Figure 8:
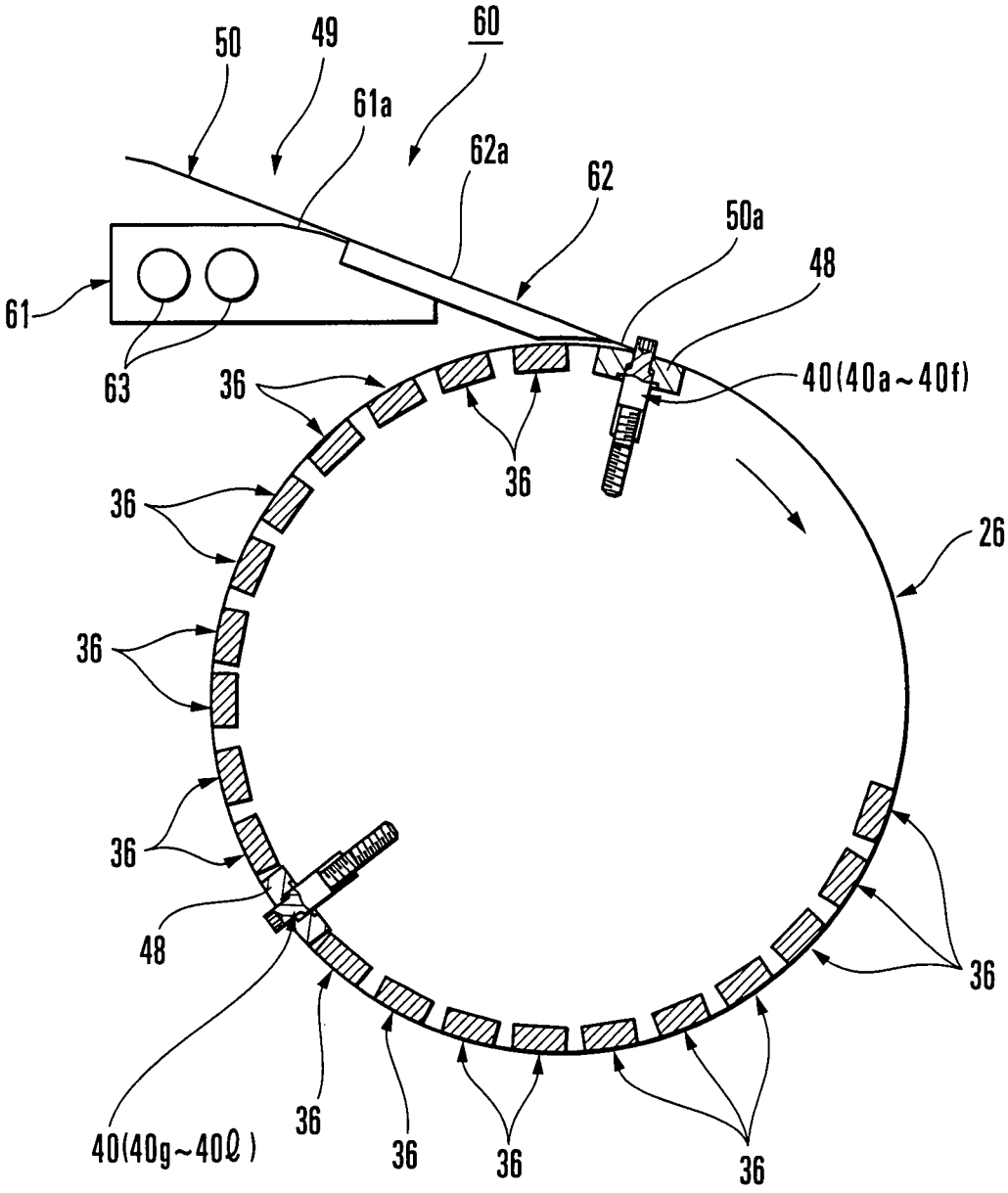
FIG. 8 is a side view of the main part showing a state of mounting the plate on the magnet cylinder.
Figure 9:
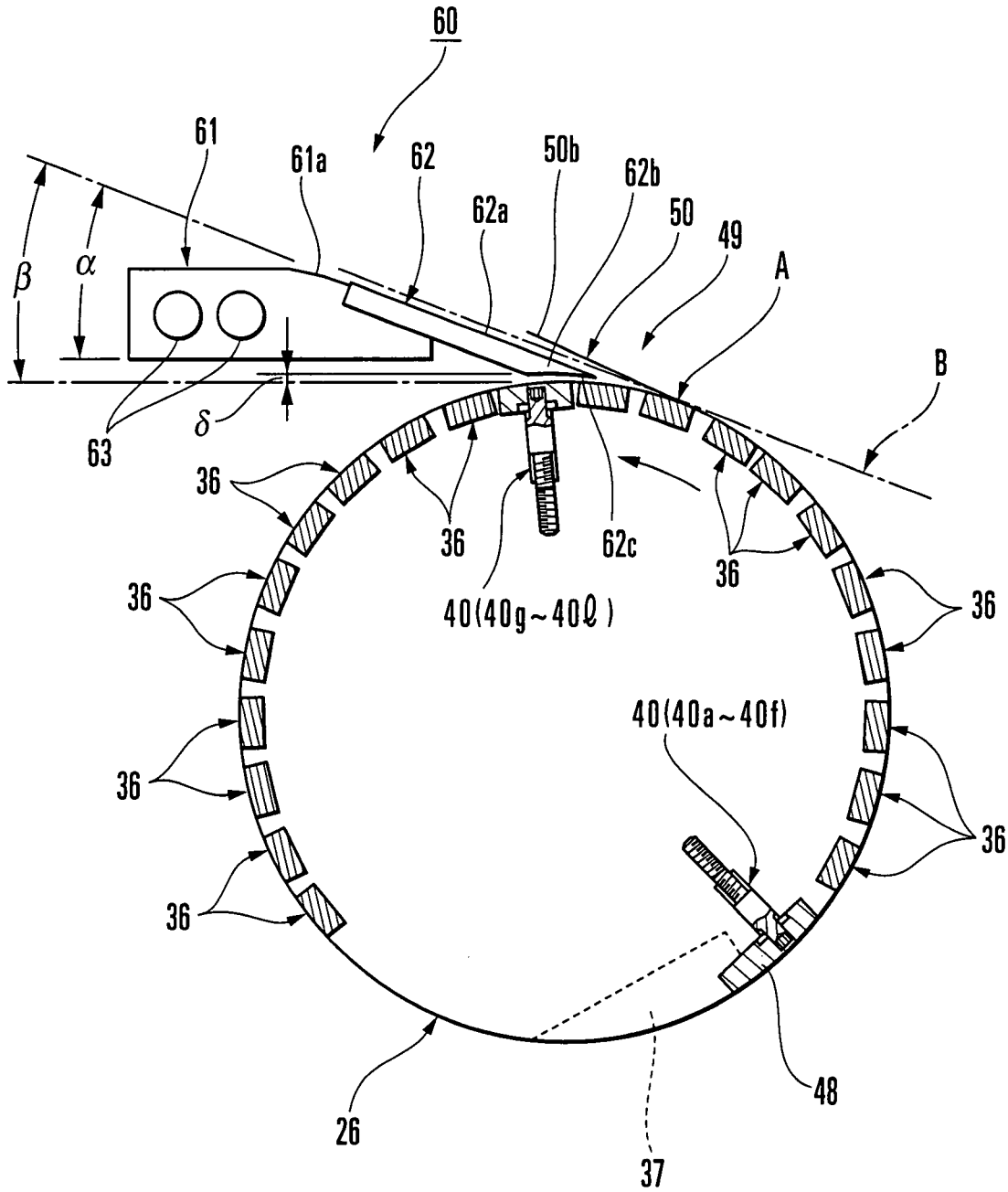
FIG. 9 is a side view of the main part showing a state of discharging the plate from the magnet cylinder.

A plate mounting cylinder according to the first embodiment of the present invention will be described with reference to FIGS. 1 to 10A, 10B, and 10C. In FIGS. 3, 8, and 9, hatching in a magnet cylinder 26 is omitted for the sake of descriptive convenience.

Figure 1:
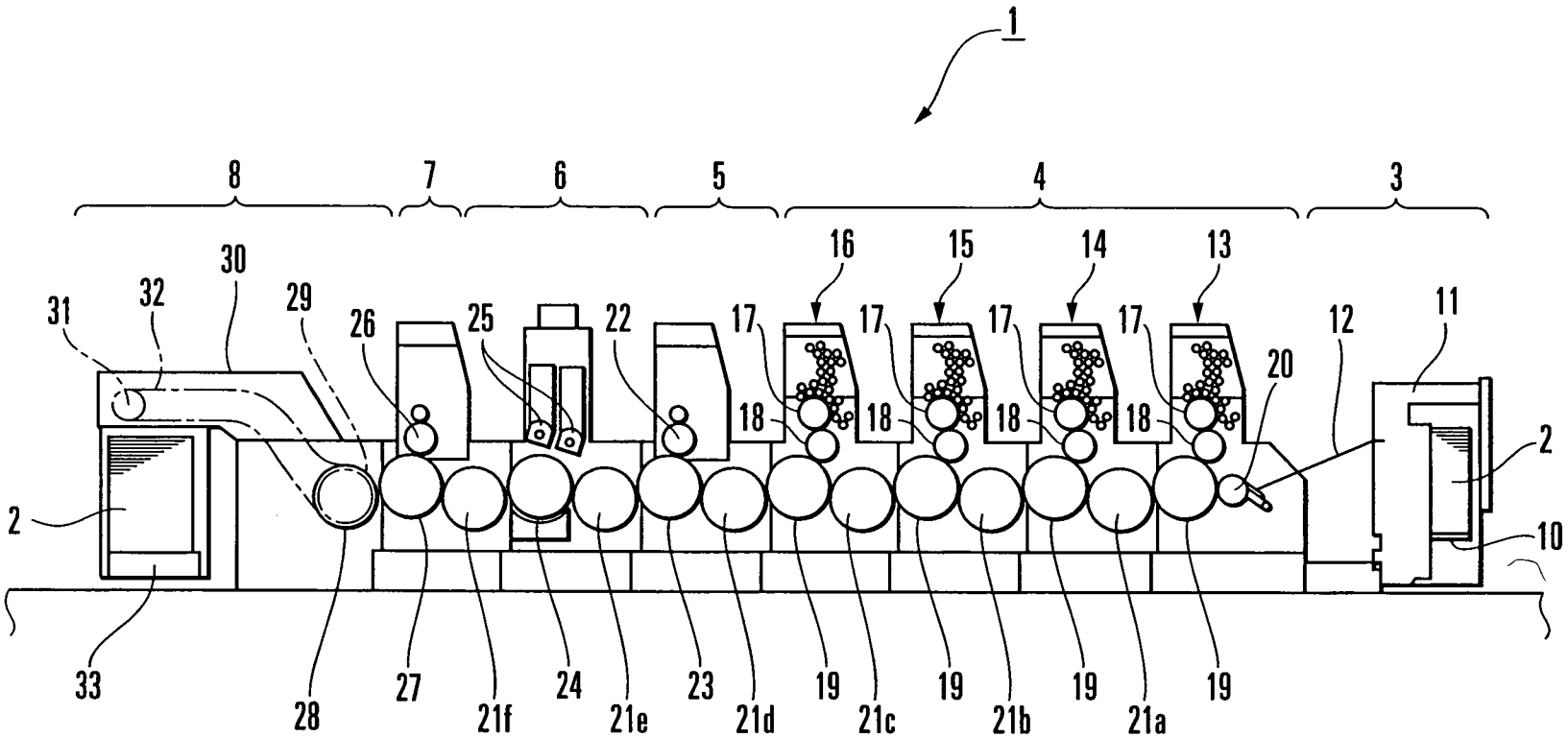
FIG. 1 is a side view showing a whole sheet-fed rotary printing press.

As shown in FIG. 1, a sheet-fed rotary printing press 1 comprises a feed unit 3 (sheet feed unit) which feeds sheets 2 one by one, a printing unit 4 which prints on the sheet 2 fed from the feed unit 3, a coating unit 5 which coats the sheet 2 conveyed from the printing unit 4 with varnish, a drying unit 6 which dries the sheet 2 conveyed from the coating unit 5, a processing device 7 which subjects the sheet 2 conveyed from the drying unit 6 to cutting with a predetermined pattern, and a delivery unit 8 (sheet delivery unit) which delivers the sheet 2 conveyed from the processing device 7.

The feed unit 3 has a pile board 10 (sheet pile means) on which the sheets 2 pile up in a stacked state, and a feed device 11 (sheet supply means) which separates the sheets 2 stacked on the pile board 10 one by one and feeds them onto a feeder board 12. The printing unit 4 has four printing units 13 to 16. Each of the printing units 13 to 16 comprises a plate cylinder 17 to which an inking device supplies ink, a blanket cylinder 18 which opposes the plate cylinder 17, and an impression cylinder 19 which opposes the blanket cylinder 18 and grips and conveys the sheet 2.

The sheet 2 that the feeder board 12 feeds to a transfer cylinder 20 is gripping-changed to and conveyed by the impression cylinder 19. When the sheet 2 passes through the gap between the blanket cylinder 18 and impression cylinder 19, it is printed with the first color. The sheet 2 on which the first color is printed is conveyed to the printing units 14, 15, and 16 through transfer cylinders 21*a*, 21*b*, and 21*c* so it is printed with second, third, and fourth colors sequentially.

The coating unit 5 comprises a varnish coating cylinder 22 to which a varnish supply device supplies varnish, and an impression cylinder 23 which opposes the varnish coating cylinder 22 and conveys the sheet 2. When the sheet 2 which is printed by the printing unit 4 and gripping-changed from a transfer cylinder 21*d* to the impression cylinder 23 passes between the impression cylinder 23 and varnish coating cylinder 22, its surface is coated with the varnish.

The drying unit 6 comprises a UV lamp 25 which dries the ink printed by the printing unit 4 and the varnish coated by the coating unit 5, and a transfer cylinder 24 which gripping-changes the sheet 2 from a transfer cylinder 21*e* and conveys the sheet 2. The processing device 7 comprises a magnet cylinder 26 with an outer surface on which a plate 49 is mounted, and an impression cylinder 27 (transport cylinder) which opposes the magnet cylinder 26 and conveys the sheet 2.

The delivery unit 8 comprises a sprocket 29 which is rotatably supported to be coaxial with a delivery cylinder 28 which opposes the impression cylinder 27 of the processing device 7, a sprocket 31 which is rotatably supported at the rear end of a delivery frame 30, and a delivery chain 32 which loops between the sprockets 29 and 31, supports delivery gripper bars (not shown), and constitutes a conveying/holding means together with the delivery gripper bars. As the delivery chain 32 travels, it conveys the sheet 2 which is gripping-changed from the impression cylinder 27 to the delivery gripper bars of the delivery chain 32. The delivery gripper bars release the sheet 2 above a delivery pile 33 to pile the sheet 2 on the delivery pile 33 (delivery means).

The magnet cylinder 26 serving as the plate mounting cylinder will be described with reference to FIGS. 2A, 2B to 4A, and 4B.

Figure 2A:
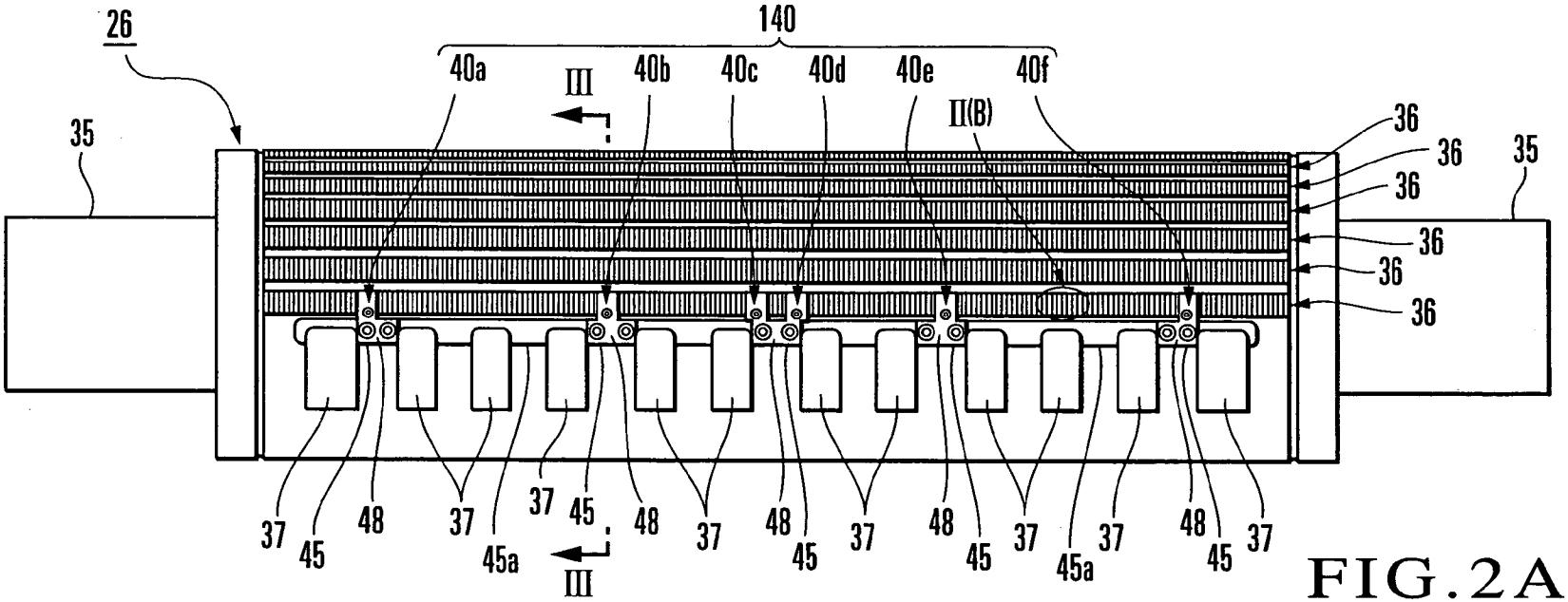
FIG. 2A is a plan view of a magnet cylinder according to the first embodiment of the present invention.
Figure 3:
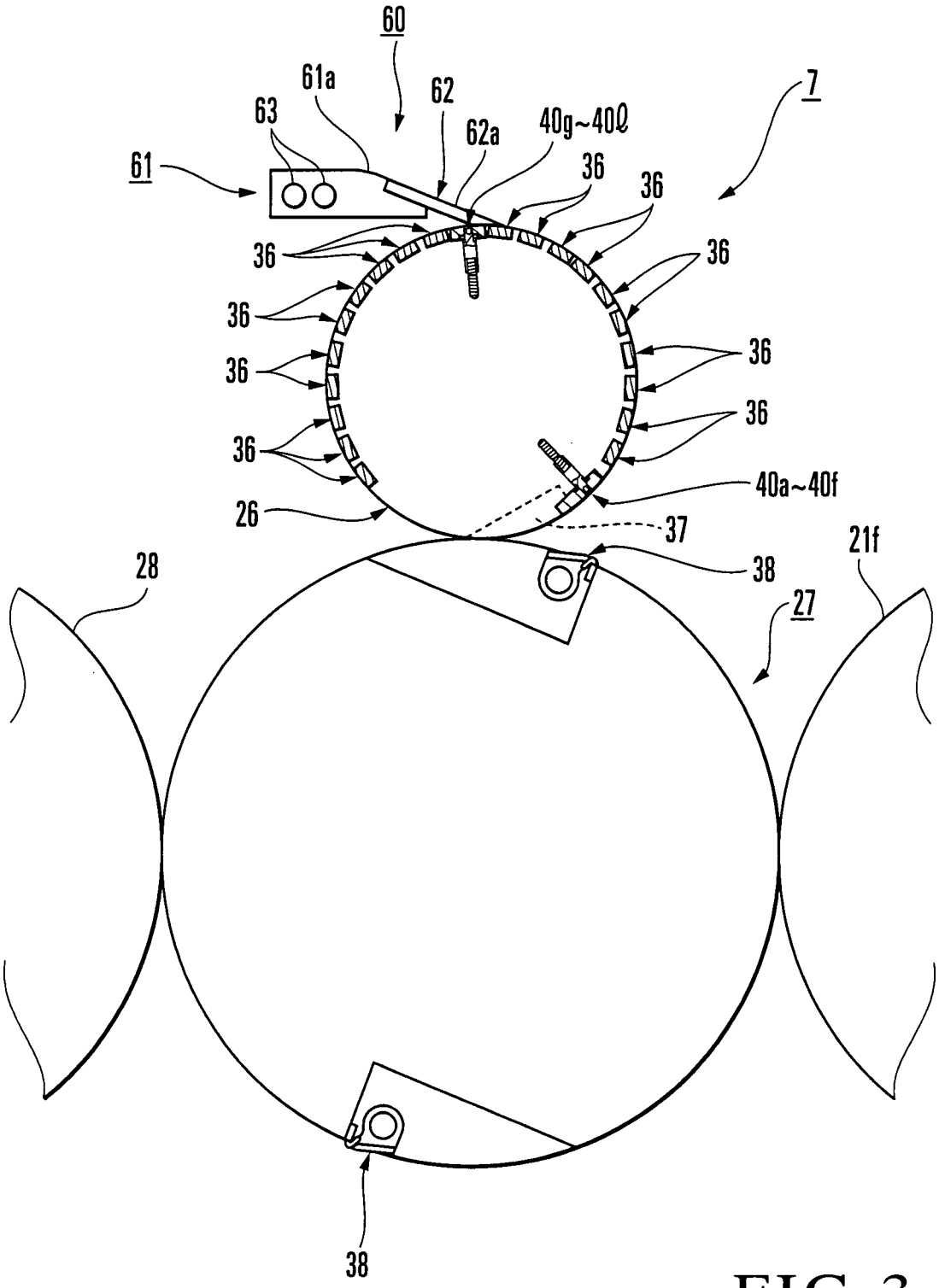
FIG. 3 is a sectional view taken along the line III-III of FIG. 2A.

As shown in FIG. 2A, the magnet cylinder 26 has end shafts 35 projecting from its two ends. A pair of frames (not shown) which oppose each other at a predetermined gap rotatably support the end shafts 35. As shown in FIG. 3, a plurality of band-like magnet portions 36 are arranged parallel to each other on the outer surface, excluding part of it, of the magnet cylinder 26 in the axial direction. The band-like magnet portions 36 attach in grooves (not shown), extending in the axial direction of the outer surface of the magnet cylinder 26, through an adhesive.

Figure 2B:
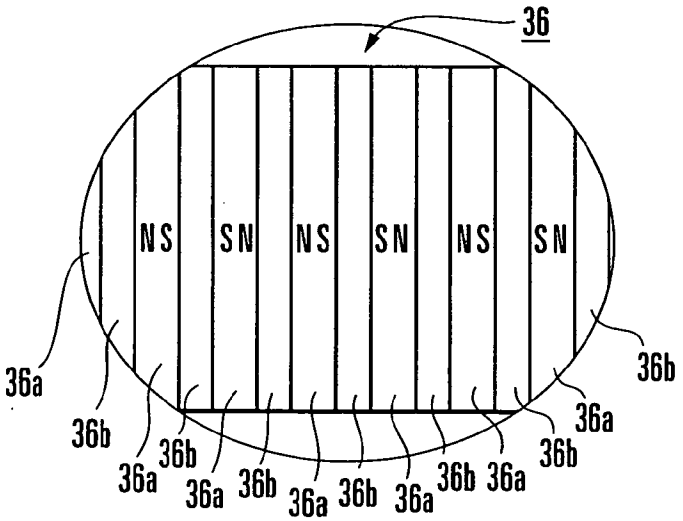
FIG. 2B is an enlarged view of a portion II(B) in FIG. 2A.

As shown in FIG. 2B, each band-like magnet portion 36 comprises a large number of magnets 36*a* and yokes 36*b* alternately arranged in the axial direction of the magnet cylinder 26. The magnets 36*a* and yokes 36*b* are adjacent to each other and adhere to the outer surface of the magnet cylinder 26 integrally with the adhesive to constitute the band-like magnet portion 36.

The magnets 36*a* are arrayed such that the same magnetic poles, i.e., an N pole and an N pole, and an S pole and an S pole, oppose each other. The yokes 36*b* formed of magnetic metal plates intervene among the magnets 36*a* and are thus magnetized. The magnetized yokes 36*b* magnetically mount a plate 49 (to be described later) on the outer surface of the magnet cylinder 26.

Figure 4A:
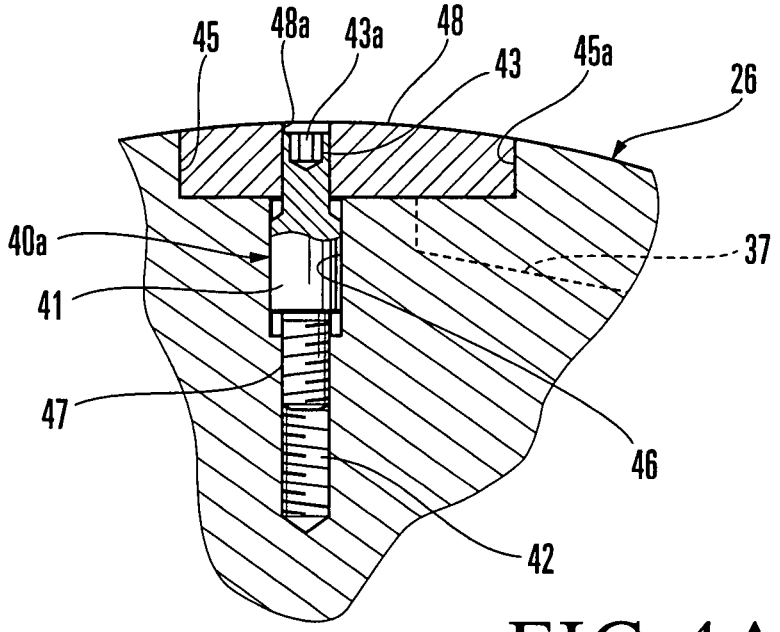
FIG. 4A is an enlarged sectional view of the main part showing a state in which a reference pin retracts in the outer surface of the magnet cylinder.
Figure 4B:
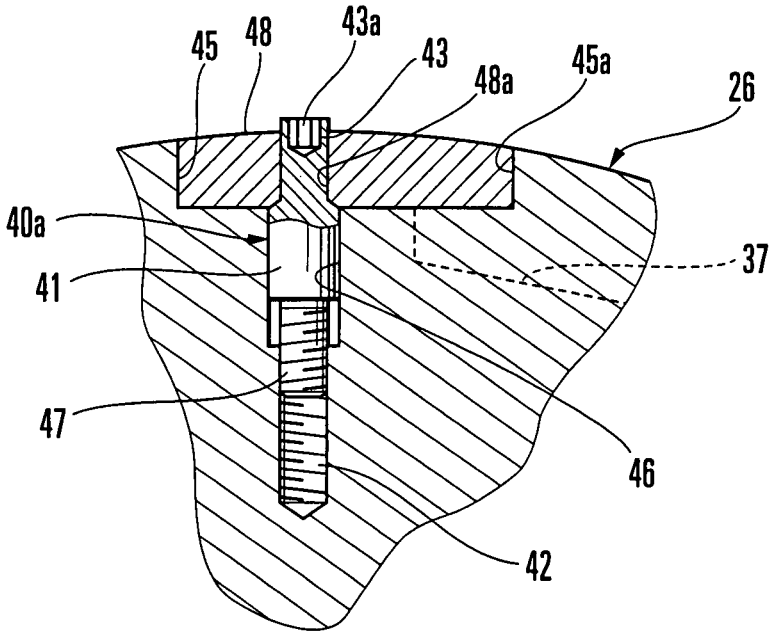
FIG. 4B is an enlarged sectional view of the main part showing a state in which the reference pin projects from the outer surface of the magnet cylinder.

As shown in FIGS. 2A and 3, two reference pin rows 140 comprising six reference pins 40*a* to 40*f*, and six reference pins 40*g* to 40*l*, respectively, to engage in engaging holes 52 of the plate 49 are provided to the outer surface of the magnet cylinder 26 at different positions in the circumferential direction, to be retractable in the axial direction. The reference pins 40*a* to 40*l* have the same structure, and will accordingly be exemplified by the reference pin 40*a* in the following description. As shown in FIGS. 4A and 4B, the reference pin 40*a* has a large-diameter portion 41 formed at the central portion, a screw portion 42 formed between the large-diameter portion 41 and the distal end, and a hexagonal blind hole 43*a* formed in a head portion 43.

The band-like magnet portion 36 also covers portions among the adjacent ones of the reference pins 40*a* to 40*l* to sandwich the reference pins 40*a* to 40*l* in the axial direction of the magnet cylinder 26. More specifically, the band-like magnet portions 36 on the same rows as the two reference pin rows 140 are each divisionally arranged excluding the retracting regions of the reference pins 40*a* to 40*f* and reference pins 40*g* to 40*l*. A plurality of rectangular recesses 37 are formed in those portions of the outer surface of the magnet cylinder 26 which have no band-like magnet portion 36, to form a row in the axial direction of the magnet cylinder 26. The recesses 37 are formed at portions to oppose grippers 38 (holding means) that line up at intervals in the axial direction of the impression cylinder 27.

A plurality of recesses 45 line up in the outer surface of the magnet cylinder 26 in the axial direction to correspond to the reference pins 40*a* to 40*l*. As shown in FIG. 2A, the recesses 45 communicate with each other through groove-like connecting recesses 45*a*. As shown in FIGS. 4A and 4B, each recess 45 has a blind support hole 46 at its center to support the large-diameter portion 41 of the reference pin 40*a* to be movable forward/backward. A screw hole 47 (female threaded portion) which threadably engages with the screw portion 42 of the reference pin 40*a* is formed in the bottom of the support hole 46.

A regulation block 48 having an insertion hole 48*a* where the head portion 43 of the reference pin 40*a* is to be inserted attaches to the recess 45. When the large-diameter portion 41 of the reference pin 40*a* abuts against the regulation block 48 (regulation member) through the insertion hole 48*a*, it regulates projection of the reference pin 40*a* from the outer surface of the magnet cylinder 26 to exceed a predetermined length.

In this arrangement, when inserting a wrench in the blind hole 43*a* of the reference pin 40*a* and rotating the reference pin 40*a* in one direction, the reference pin 40*a* moves forward, and the head portion 43 retracts in the recess 45 from the outer surface of the magnet cylinder 26, as shown in FIG. 4A. When rotating the reference pin 40*a* in the other direction, the reference pin 40*a* moves backward, and the head portion 43 projects from the outer surface of the magnet cylinder 26, as shown in FIG. 4B.

Figure 5A:
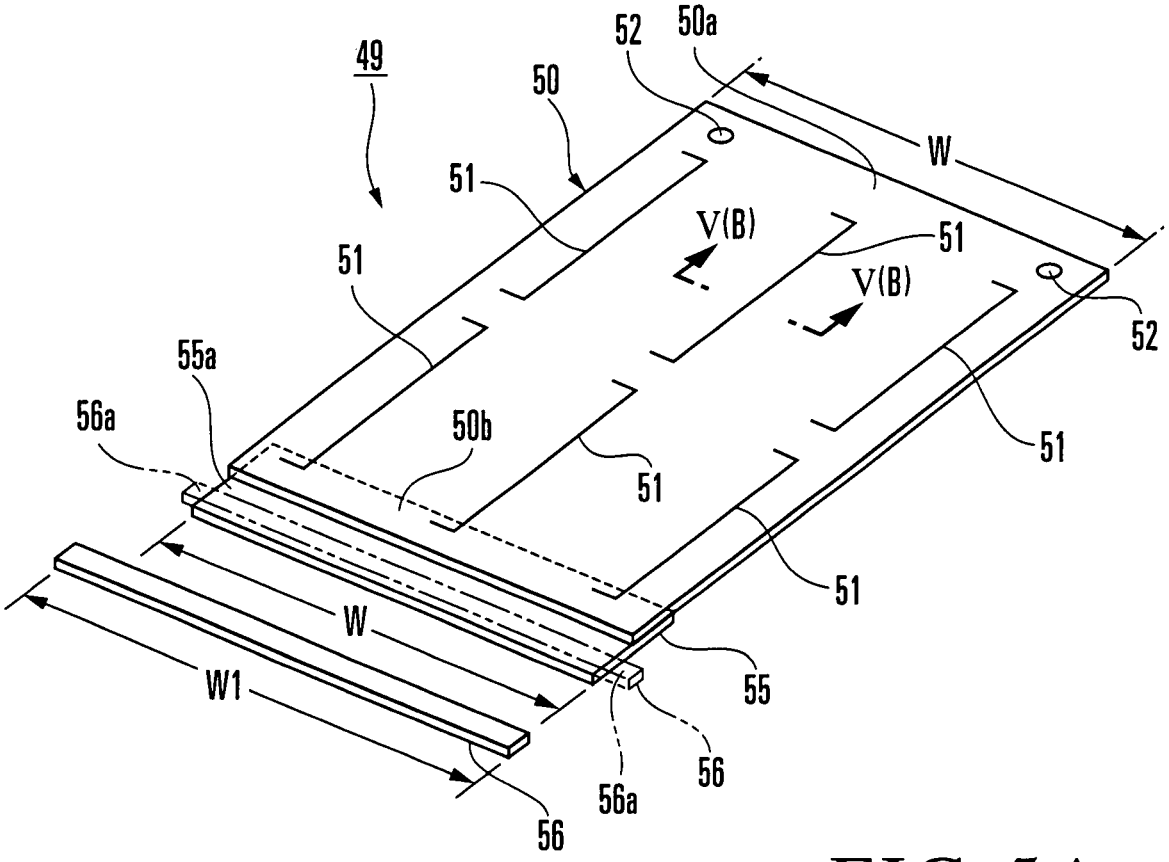
FIG. 5A is a perspective view of a plate to be mounted on the magnet cylinder shown in FIG. 2A.

The plate 49 to be magnetically mounted on the outer surface of the magnet cylinder 26 will be described with reference to FIGS. 5A and 5B. The plate 49 comprises a main body 50 formed of a rectangular thin plate-like magnetic metal member to be magnetically mounted on the outer surface of the magnet cylinder 26, a nonmagnetic sheet 55 provided to one edge (trailing edge) 50*b* in the vertical direction of the main body 50 and serving as a nonmagnetic portion, and a magnetic piece 56 magnetically held by the outer surface of the magnet cylinder 26 through the nonmagnetic sheet 55 and serving to bring the nonmagnetic sheet 55 into contact with the outer surface of the magnet cylinder 26.

The main body 50 is formed of a flexible thin plate-like magnetic member into a rectangular shape, and has six cutting blades 51, each of which has a U-shape when seen from the top, on its upper surface. The main body 50 has a pair of engaging holes 52, serving as reference engaging portions to engage with the reference pins 40*a* to 40*f*, in the two ends in the widthwise direction of its leading edge 50*a*.

Figure 5B:
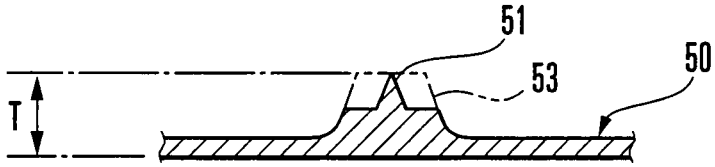
FIG. 5B is a sectional view taken along the line V(B)-V(B) of FIG. 5A.

The main body 50 is etched, except for the cutting blades 51, to form the cutting blades 51 into a predetermined height, thus forming trapezoidal projections 53 indicated by an alternate long and two short dashed line in FIG. 5B. Subsequently, an NC (Numerical Control) processing machine forms the cutting blades 51 with triangular sections on the projections 53.

At this time, the pair of engaging holes 52 are formed using the same NC processing machine. Formation of the cutting blades 51 and engaging holes 52 in the main body 50 using the same NC processing machine in this manner positions the cutting blades 51 always accurately with respect to the engaging holes 52.

The nonmagnetic sheet 55 is formed flat from a flexible thin plate-like plastic (resin) member. That portion of the nonmagnetic sheet 55 which has a width W the same as that of the main body 50 and overlaps the main body 50 bonds to the under surface (opposing surface to the outer surface of the magnet cylinder) of the trailing edge 50*b* of the main body 50 throughout the entire widthwise direction. The remaining half of the nonmagnetic sheet 55 projects from the trailing edge 50*b* of the main body 50 to form a protrusion 55*a*. The magnetic piece 56 is formed of a band-like member made of a ferromagnetic material and having a rectangular section, and has a width W1 larger than the width W of the nonmagnetic sheet 55.

Figure 10A:
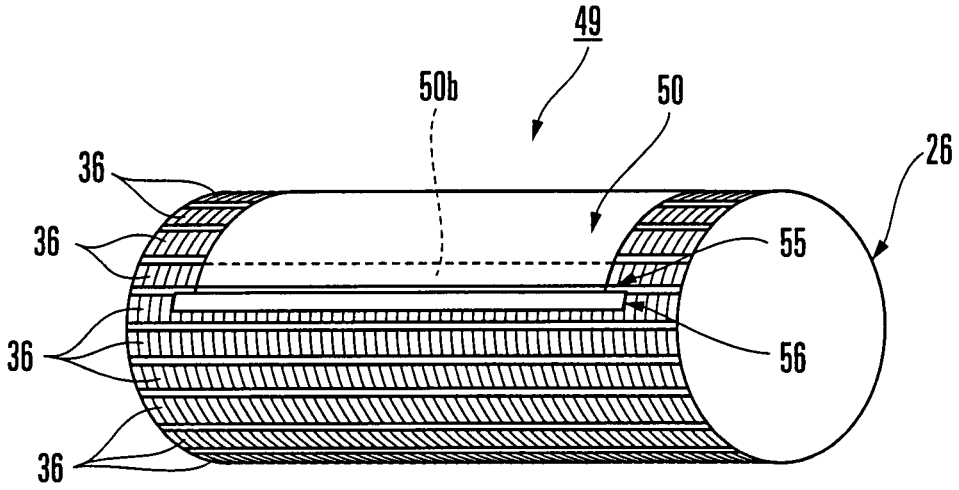
FIGS. 10A and 10B are a perspective view and enlarged sectional view of the main part, respectively, of the magnet cylinder on which the plate is mounted.
Figure 10B:
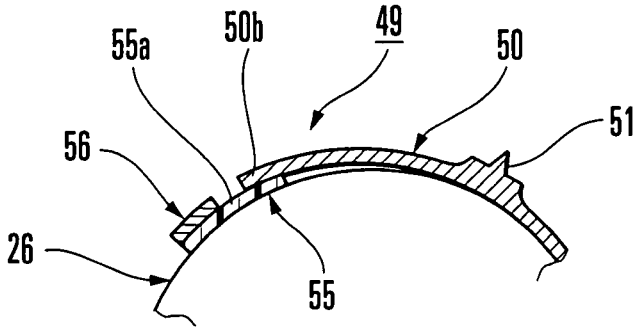

When magnetically mounting the plate 49 having the above arrangement on the outer surface of the magnet cylinder 26, the magnetic piece 56 is placed on the protrusion 55*a* (the bonding surface side with the plate 49) of the nonmagnetic sheet 55 and magnetically held by the outer surface of the magnet cylinder 26. Thus, the magnetic piece 56 and the outer surface of the magnet cylinder 26 sandwich the protrusion 55*a* of the nonmagnetic sheet 55, as shown in FIG. 10B. At this time, the nonmagnetic sheet 55 curves along the outer surface of the magnet cylinder 26 to come into tight contact with the outer surface of the sheet 2.

Figure 6A:
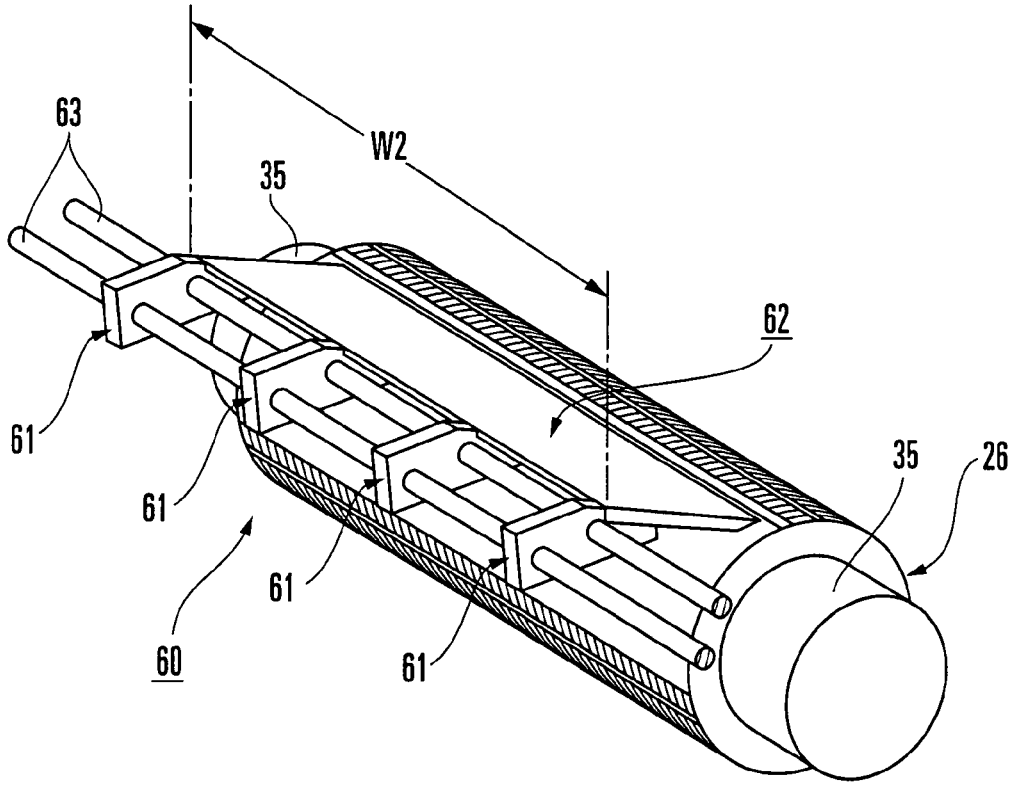
FIG. 6A is a perspective view of the magnet cylinder shown in FIG. 2A.

A guide device which guides the plate 49 when mounting the plate 49 on the magnet cylinder 26 and discharging the plate 49 from the magnet cylinder 26 will be described with reference to FIGS. 6A and 6B to 9. As shown in FIG. 6A, a guide device 60 comprises four guide pieces 61 which line up in the axial direction of the magnet cylinder 26, and a guide plate 62 which attaches to the upper portions of the guide pieces 61 and extends in the axial direction of the magnet cylinder 26.

Two bars 63 horizontally extending between a pair of frames (not shown) support the guide pieces 61. As shown in FIG. 9, each guide piece 61 has a first guide surface 61*a* (guide portion) at its upper end to be inclined downward at an angle a toward the magnet cylinder 26. The guide plate 62 has a second guide surface 62*a* on its upper surface to link to the first guide surfaces 61*a* of the guide pieces 61. The guide plate 62 attaches to the guide pieces 61 such that the second guide surface 62*a* is inclined at an inclination angle a which is the same as that of the first guide surfaces 61*a* and that the first guide surfaces 61*a* link to the second guide surface 62*a* with no steps.

The guide plate 62 has a wedge-like end 62*b* which is close to the outer surface of the magnet cylinder 26. The upper surface of the wedge-like end 62*b* forms a plane continuous to the second guide surface 62*a*. More specifically, the second guide surface 62*a* extends to the distal end of the upper surface of the wedge-like end 62*b*. An opposing surface 62*c* of the end 62*b* which opposes the outer surface of the magnet cylinder 26 is spaced apart from the outer surface of the magnet cylinder 26 by a gap δ. The gap δ is set to be slightly larger than a height T (FIG. 5B) from the under surface of the main body 50 of the plate 49 to the distal ends of the cutting blades 51.

When the magnet cylinder 26 rotates in a discharging direction to remove the magnetic piece 56 and the nonmagnetic sheet 55 levitates is separated from the outer surface of the magnet cylinder 26, the guide plate 62 is located between the protrusion 55*a* of the nonmagnetic sheet 55 and the outer surface of the magnet cylinder 26. Subsequently, when the magnet cylinder 26 rotates in the discharging direction, the guide plate 62 removes the plate 49 from the outer surface of the magnet cylinder 26 and guides the plate 49 to be discharged.

The angle of the distal end of the magnet cylinder 26-side end 62*b* of the guide plate 62, that is, an angle β that the second guide surface 62*a* and the opposing surface 62*c* form, is set to an acute angle. When the guide plate 62 is to remove the plate 49 mounted on the magnet cylinder 26 from the outer surface of the magnet cylinder 26, the second guide surface 62*a* of the guide plate 62 is positioned to almost coincide with a tangential plane B of the magnet cylinder 26 at a removing portion A of the plate 49.

Figure 7:
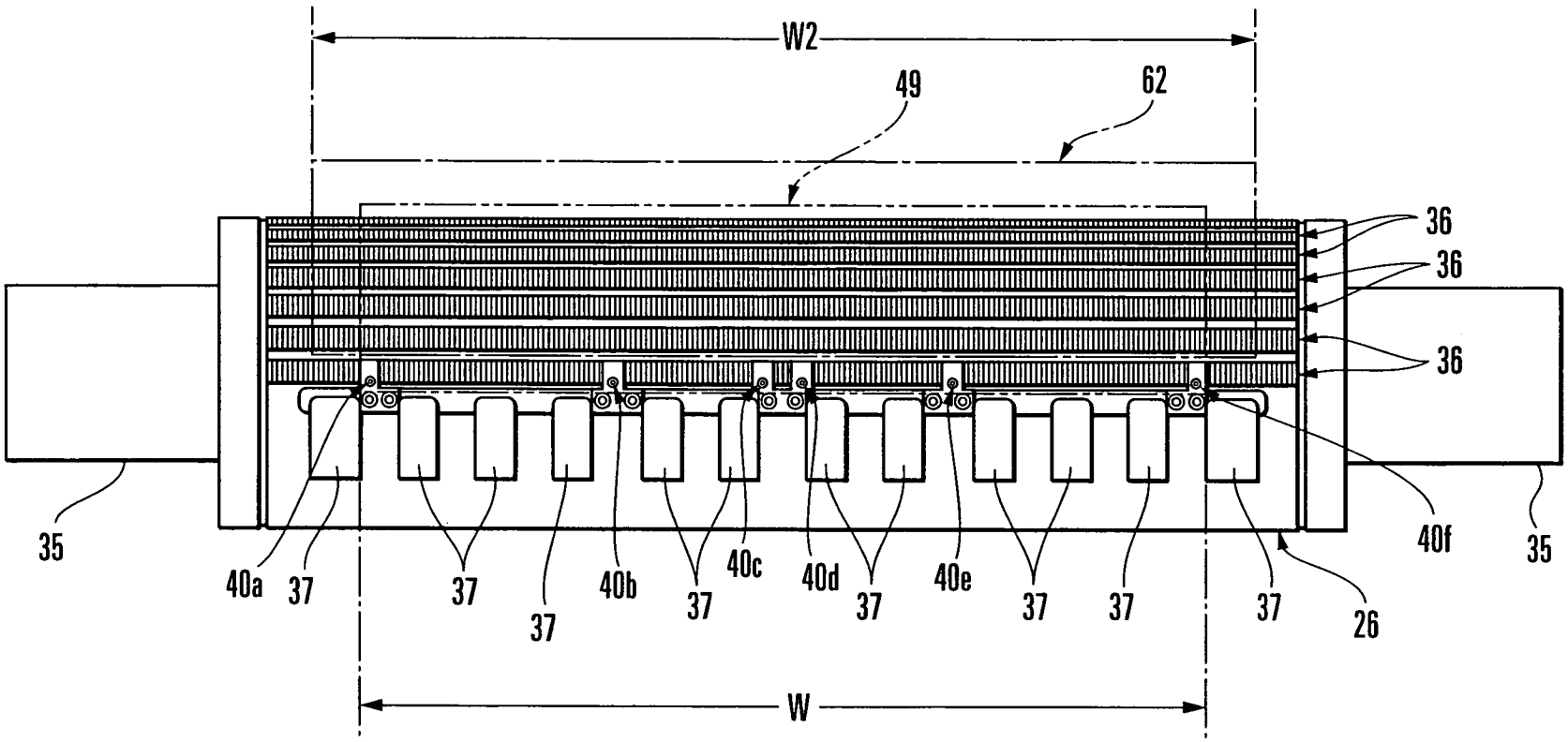
FIG. 7 is a plan view of the magnet cylinder shown in FIG. 2A.

As shown in FIG. 7, the length (width W2) of the guide plate 62 in the axial direction of the magnet cylinder 26 is set to be larger than the width W of the plate 49 which has the maximal width. More specifically, the guide plate 62 is provided to be able to guide the plate 49 of the maximum width W that can be mounted on the magnet cylinder 26.

The operation of mounting the plate 49 on the outer surface of the magnet cylinder 26 in the processing device 7 having the above arrangement will be described. First, of the 12 reference pins 40*a* to 40*f* and 40*g* to 40*l*, necessary reference pins are caused to project from the outer surface of the magnet cylinder 26. According to this embodiment, a case of mounting a plate 49 having a maximal size in the widthwise and vertical directions will be described which. In this case, on the leading side, the two, reference pins 40*a* and 40*f* are caused to project from the outer surface of the magnet cylinder 26.

The operator inserts a wrench in the blind holes 43*a* of the reference pins 40*a* and 40*f* to rotate the reference pins 40*a* and 40*f* in the other direction. Then, the reference pins 40*a* and 40*f* move backward, and their head portions 43 project from the outer surface of the magnet cylinder 26, as shown in FIG. 4B.

Figure 6B:
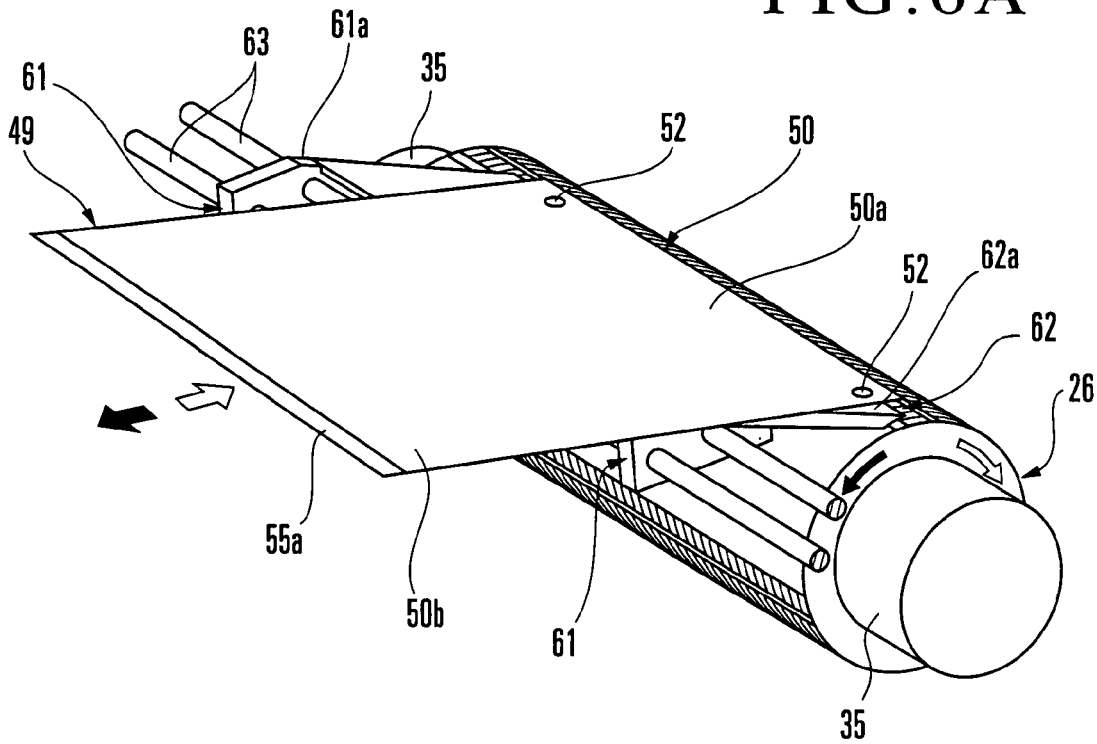
FIG. 6B is a view to explain plate mounting/discharge operation.

Subsequently, the operator holds the plate 49 and places it on the guide pieces 61 and guide plate 62 with the leading edge 50*a* opposing the magnet cylinder 26, as shown in FIG. 6B. In this state, the pair of engaging holes 52 of the plate 49 are engaged with the reference pins 40*a* and 40*f*, as shown in FIG. 8. At this time, the plate 49 is placed on the guide pieces 61 and guide plate 62 and spaced apart from the outer surface of the magnet cylinder 26. Thus, before the pair of engaging holes 52 engage with the reference pins 40*a* and 40*f*, the plate 49 will not be erroneously, magnetically mounted on the outer surface of the magnet cylinder 26.

Hence, the operator need not remove an erroneously mounted plate 49 from the outer surface of the magnet cylinder 26 against magnetic force, and can mount the plate 49 can be mounted on the outer surface of the magnet cylinder 26 easily. After the pair of engaging holes 52 engage with the reference pins 40*a* and 40*f*, the magnet cylinder 26 rotates in the mounting direction (clockwise in FIG. 8) indicated by an arrow.

When the magnet cylinder 26 rotates, the plate 49 is magnetically mounted on the outer surface of the magnet cylinder 26 sequentially from the leading edge 50*a* side while the first guide surfaces 61*a* of the guide pieces 61 and the second guide surface 62*a* of the guide plate 62 guide the plate 49. After the trailing edge 50*b* of the plate 49 is magnetically mounted on the outer surface of the magnet cylinder 26, the magnetic piece 56 covers the protrusion 55*a* of the nonmagnetic sheet 55 and is magnetically held on the outer surface of the magnet cylinder 26, as shown in FIG. 10B By holding the magnetic piece 56, the magnetic piece 56 and the outer surface of the magnet cylinder 26 sandwich the protrusion 55*a*. The protrusion 55*a* curves along the outer surface of the magnet cylinder 26 to come into tight contact with the outer surface of the magnet cylinder 26. At this time, as the width W1 of the magnetic piece 56 is larger than the width W of the nonmagnetic sheet 55, two ends 56*a* or at least one end 56*a* of the magnetic piece 56 projects from the end of the nonmagnetic sheet 55 in the widthwise direction, as shown in FIG. 5A. This allows the protrusion 55*a* to come into tight contact with the outer surface of the magnet cylinder 26 in the widthwise direction.

After mounting the plate 49 onto the magnet cylinder 26, the operator inserts the wrench in the blind holes 43*a* of the reference pins 40*a* and 40*f* to rotate the reference pins 40*a* and 40*f* in one direction. Thus, as shown in FIG. 4A, the reference pins 40*a* and 40*f* move forward, and their head portions 43 retract in the recesses 45 from the outer surface of the magnet cylinder 26.

When driving the sheet-fed rotary printing press 1 in this state, as the sheet 2 which is gripping-changed from a transfer cylinder 21*f* (FIG. 3) to the impression cylinder 27 passes through the gap between the impression cylinder 27 and magnet cylinder 26, the cutting blades 51 of the plate 49 shear the sheet 2 along a predetermined outline. As the outer surface of the magnet cylinder 26 has the recesses 37 opposing the grippers 38 of the impression cylinder 27, the grippers 38 will not damage the outer surface of the magnet cylinder 26 nor will be damaged.

The band-like magnet portion 36 also covers the portion between the reference pins 40*a* and 40*f* to sandwich the reference pins 40*a* and 40*f* in the axial direction. Hence, the plate 49 can be mounted such that part of it where the pair of engaging holes 52 are formed, i.e., the leading edge 50*a*, is in tight contact with the outer surface of the magnet cylinder 26.

As the same NC processing machine is used to form the cutting blades 51 and engaging holes 52 in the plate 49, the engaging holes 52 can be positioned with respect to the cutting blades 51 always accurately. This can improve the positioning accuracy of the cutting blades 51 of the plate 49 when the pair of engaging holes 52 engage with the reference pins 40*a* and 40*f* of the magnet cylinder 26. Consequently, the wasted paper that registration adjustment has taken conventionally can reduce.

The operation of discharging the plate 49 mounted on the outer surface of the magnet cylinder 26 in this manner will be described. First, the magnet cylinder 26 is rotated, so the trailing edge 50*b* of the plate 49 mounted on the outer surface of the magnet cylinder 26 opposes the end 62*b* of the guide plate 62, as shown in FIG. 9. Subsequently, the operator holds the ends 56*a* of the magnetic piece 56 and removes the magnetic piece 56 from the outer surface of the magnet cylinder 26, as shown in FIG. 10C.

Figure 10C:
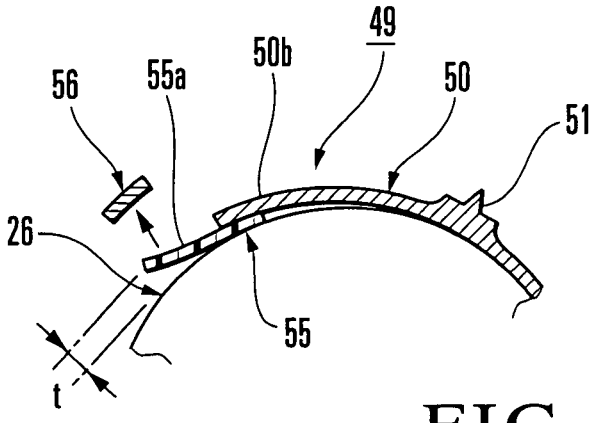
FIG. 10C is an enlarged sectional view of the main part showing a state of removing the plate.

When removing the magnetic piece 56, by the restoration force of the nonmagnetic sheet 55 itself that the magnetic piece 56 has been pressing against the outer surface of the magnet cylinder 26, the protrusion 55*a* of the nonmagnetic sheet 55 levitates is separated from the outer surface of the magnet cylinder 26 by a height t (FIG. 10C). At this time, as the nonmagnetic sheet 55 is made of a nonmagnetic material, it will not be magnetically mounted again on the outer surface of the magnet cylinder 26. Thus, the operator need not manually hold the removed portion of the nonmagnetic sheet 55. Consequently, the operator need not remove the nonmagnetic sheet 55 with one hand while holding the removed portion with the other hand. This facilitates the operation and can reduce the load of the operation.

Once the nonmagnetic sheet 55 is separate, as the nonmagnetic sheet 55 extends in the entire widthwise direction of the main body 50 of the plate 49, the entire trailing edge 50*b* of the plate 49 levitates from the outer surface of the magnet cylinder 26. In this state, the magnet cylinder 26 is rotated in the discharging direction (counterclockwise in FIG. 9). As the end 62*b* of the guide plate 62 is located between the levitated protrusion 55*a* of the nonmagnetic sheet 55 and the outer surface of the magnet cylinder 26, when the magnet cylinder 26 rotates in the discharging direction, the levitated protrusion 55*a* rides on the second guide surface 62*a* of the guide plate 62.

In this manner, as the trailing edge 50*b* of the plate 49 is provided with the nonmagnetic sheet 55, the protrusion 55*a* of the nonmagnetic sheet 55 levitates from the outer surface of the magnet cylinder 26. Thus, the levitated protrusion 55*a* smoothly rides on the guide plate 62. The conventionally required cumbersome operation of removing the trailing edge 50*b* from the outer surface of the magnet cylinder 26 with a spatula or the like becomes unnecessary. As a result, the trailing edge 50*b* of the plate 49 can be separated reliably and readily, and the plate 49 or the outer surface of the magnet cylinder 26 will not be damaged by a spatula or the like.

When the magnet cylinder 26 rotates in the discharging direction, the trailing edge 50*b* of the plate 49 which has been magnetically mounted on the outer surface of the magnet cylinder 26 rides on the second guide surface 62*a* of the guide plate 62. Thus, the plate 49 is sequentially removed from the outer surface of the magnet cylinder 26 from its trailing edge 50*b*.

At this time, as the angle β that the second guide surface 62*a* of the guide plate 62 and the opposing surface 62*c* form is an acute angle, the end 62*b* of the guide plate 62 serves like a knife edge. Thus, the end 62*b* will not damage the plate 49, so the plate 49 can be separated from the magnet smoothly. As the guide device 60 can remove the plate 49 mounted on the outer surface of the magnet cylinder 26, the plate 49 need not be manually removed as in a conventional case, thus reducing the load of the operator.

The second guide surface 62*a* (section) of the guide plate 62 is set to almost coincide with a contact B of the magnet cylinder 26 at a removing point A (FIG. 9) of the plate 49. This allows the second guide surface 62*a* to discharge and guide the plate 49 in a flat state. Hence, the plate 49 will not bend and can be reused. Also, the plate 49 can be discharged smoothly without being caught by the second guide surface 62*a*.

As the discharged plate 49 separates from the outer surface of the magnet cylinder 26 and is supported on the guide plate 62 and guide pieces 61, it will not be magnetically mounted erroneously on the outer surface of the magnet cylinder 26. Thus, the operation of removing an erroneously mounted plate 49 from the outer surface of the magnet cylinder 26 against the magnetic force of the magnet cylinder 26 becomes unnecessary. As the plate 49 is not bent, it can be reused.

The guide device 60 automatically guides the plate 49 which is discharged from the magnet cylinder 26. Thus, the operator need not remove the plate 49 manually against the magnetic force of the magnet cylinder 26 while holding the plate 49. This can reduce the load of the operator. After removing the magnetic piece 56 from the outer surface of the magnet cylinder 26, the plate 49 can be discharged by only rotating the magnet cylinder 26 in the discharging direction. This can reduce the load of the operator and facilitate the discharging operation.

Figure 11:
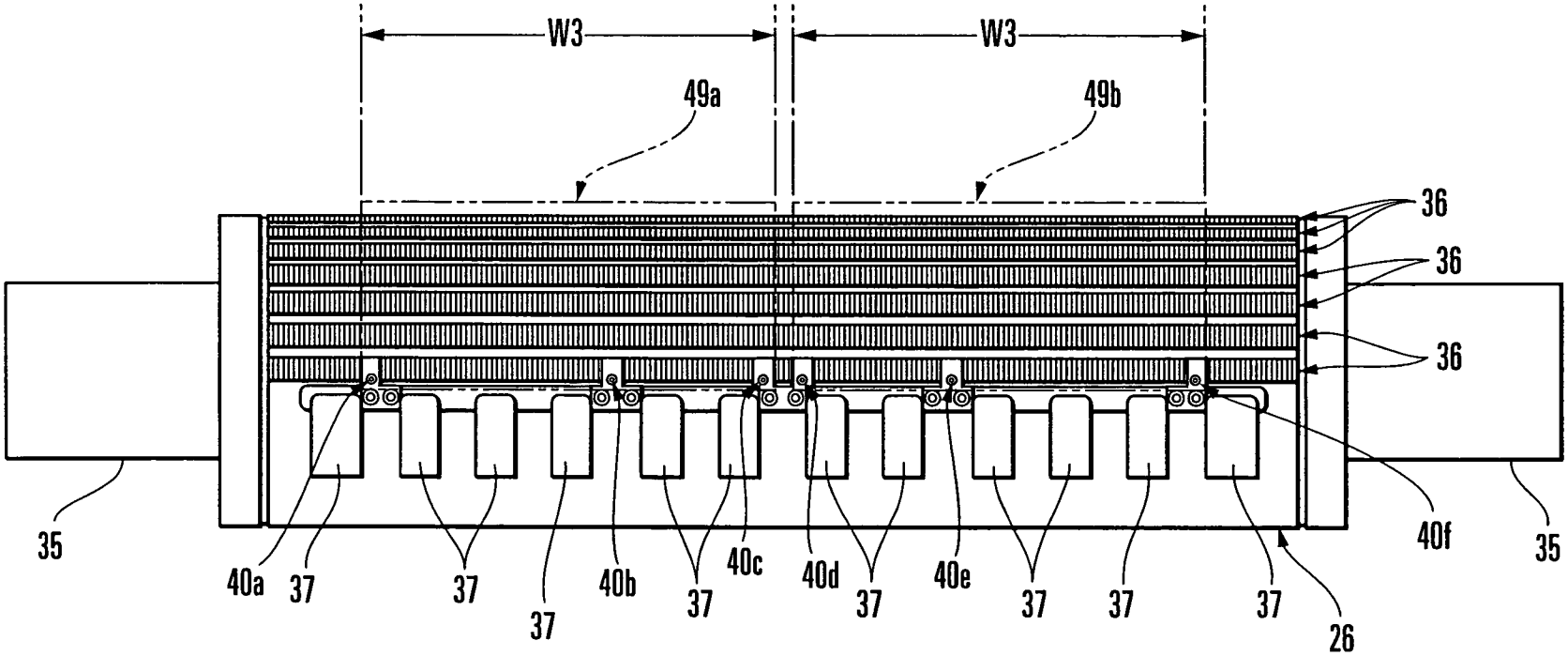
FIG. 11 is a plan view of a magnet cylinder according to the second embodiment of the present invention.

A plate mounting cylinder according to the second embodiment of the present invention will be described with reference to FIG. 11. According to the second embodiment, two plates 49*a* and 49*b* (divisional plates), each having an area almost half that of the plate 49, are mounted on the outer surface of a magnet cylinder 26 to line up in the axial direction. One plate 49*a* is magnetically mounted on one half of the outer surface of the magnet cylinder 26 by selectively engaging a pair of engaging holes 52 with reference pins 40*a* and 40*c*. The other plate 49*b* is magnetically mounted on the remaining half of the outer surface of the magnet cylinder 26 by selectively engaging a pair of engaging holes 52 with reference pins 40*d* and 40*f*.

In this manner, by mounting the plurality of plates 49*a* and 49*b* having small sizes in the widthwise direction on a necessary portion of one magnet cylinder 26 to line up in the axial direction, no unnecessary portion need be reserved on one plate. Thus, a plate with a size corresponding to the necessary portion can be used. This can reduce the cost of the base material to form the plate.

Also, a plurality of types of plates which perform a plurality of processes can be mounted on the outer surface of the magnet cylinder 26 simultaneously. This can improve the productivity and reduce the manufacturing cost. This embodiment was exemplified by plates having small sizes in the widthwise direction. When plates having small sizes in the vertical direction are to be employed, the plurality of plates can be mounted to line up in the circumferential direction of the magnet cylinder 26 by selectively engaging a pair of engaging holes 52 with two of remaining reference pins 40*g* to 40*l*.

In this case, a plurality of plates (divisional plates) having small sizes in the vertical direction can also be mounted on one magnet cylinder 26. A plate having a necessary size can thus be used without providing the plate with an unnecessary portion. This can reduce the cost of the material base to form the plates. Also, the plurality of types of plates can be mounted on the outer surface of the magnet cylinder 26 simultaneously. This can improve the productivity and reduce the manufacturing cost.

Figure 12:
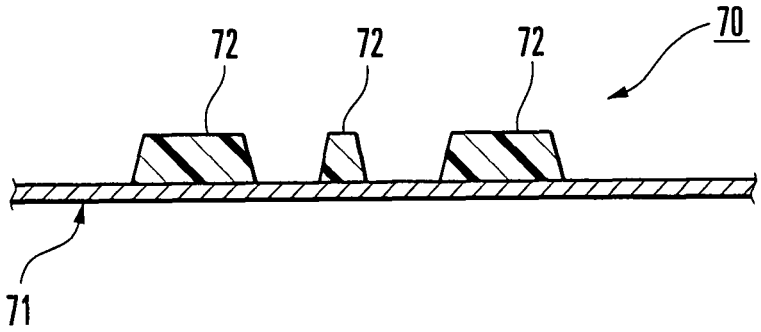
FIG. 12 is a side view of the main part showing another example of the plate to be mounted on the magnet cylinder.

Another example of the plate to be used in the present invention will be described with reference to FIG. 12. According to this example, a plate 70 is embossed. The plate 70 comprises a flexible metal base plate 71 made of a thin, rectangular plate-like ferromagnetic body, and a plurality of projections 72 with different shapes which project on the base plate 71 and are made of a photosensitive resin.

By magnetically mounting the plate 70 on the outer surface of a magnet cylinder 26, when a sheet 2 that grippers 38 of an impression cylinder 27 grip and convey passes through a counterpoint of the magnet cylinder 26, the projections 72 emboss the sheet 2.

In the embodiments described above, as the reference engaging portions, U-shaped grooves may be employed in place of the engaging holes 52. Although the plate 49 having the cutting blades 51 and the embossing plate 70 are described, a plate having scoring blades in place of the cutting blades 51, or a plate member to be used for printing/coating may be employed. In fine, any flexible thin plate-like metal plate made of a ferromagnetic body or any plate-like member partly having a thin plate-like metal plate can be employed. Although the sheet 2 is employed as the material to be processed by the plate 49, a film-like sheet or an aluminum plate which forms a thin plate may be employed. The material to be processed is not limited to a sheet but can be a web.

In the embodiments described above, as each reference pin row 140, six reference pins are arranged in the axial direction of the magnet cylinder 26. Four or more reference pins suffices, and seven or more reference pins may be provided. Although the two reference pin rows 140 are arranged in the circumferential direction of the magnet cylinder 26, the number of reference pin rows may be one, and three or more reference pin rows may be provided where necessary. Although the width W1 of the magnetic piece 56 is larger than the width W of the nonmagnetic sheet 55, it may be equal to the width W of the nonmagnetic sheet 55.

In the embodiments described above, the guide device 60 fixes to a pair of opposing frames through the bars 63. Alternatively, the guide device 60 may be movably supported so that it is moved to a position close to the outer surface of the magnet cylinder 26 only when mounting/discharging the plate 49 on/from the outer surface of the magnet cylinder 26, and moves to a retreat position otherwise. The guide device 60 may be detachably supported by the pair of opposing frames, and may be moved to a position close to the outer surface of the magnet cylinder 26 only when mounting/discharging the plate 49 on/from the outer surface of the magnet cylinder 26.

As has been described above, according to the present invention, since a nonmagnetic portion which is not magnetically mounted on the outer surface of the magnet cylinder is exposed when removing a magnetic piece, the plate can be removed from the nonmagnetic portion. Hence, the conventionally required cumbersome operation of removing the trailing edge of the plate from the outer surface of the magnet cylinder with a spatula or the like becomes unnecessary. As a result, the trailing edge of the plate can be separated reliably and readily, and the plate or the outer surface of the magnet cylinder will not be damaged by a spatula or the like.

The nonmagnetic portion levitates from the outer surface of the magnet cylinder, and it will not be erroneously mounted again on the outer surface of the magnet cylinder. Thus, the operator need not remove the trailing edge of the plate with one hand toward one end in a widthwise direction while holding the other end in the widthwise direction of the trailing edge of the plate with the other hand. This can facilitate the operation, reduce the load of the operation, and shorten an operation time.

What is claimed is:

1. A printing plate assembly for a magnet cylinder which magnetically holds the plate, comprising:

a main body of the plate which main both is formed of a flexible thin plate-like magnetic material for magnetically mounting on an outer surface of the magnet cylinder;

a non-magnetic sheet which is formed from a flexible thin plate-like member and partially bonded only to one end portion of said main body to project from the end portion of said main body, wherein one half of said non-magnetic sheet in the vertical direction of said main body overlaps the one end portion of said main body and the remaining half of said non-magnetic sheet in the vertical direction of said main body projects from the one end portion of said main body; and a magnetic piece configured to be magnetically attracted toward and retained against the outer surface of the magnet cylinder through said non-magnetic sheet to thereby hold said main body to the outer surface of the magnet cylinder, when said main body is mounted on the outer surface of the magnet cylinder, wherein said main body, non-magnetic sheet and magnetic piece are configured so that when the plate is to be dismounted from the magnet cylinder, by removing said magnetic piece from said non-magnetic sheet, only said non-magnetic sheet lifts away from the outer surface of the magnet cylinder in a state said main body is magnetically held on the magnet cylinder.

2. A printing plate assembly according to claim 1, wherein said non-magnetic sheet is provided throughout an entire range of said one end of said main body in an axial direction of said magnet cylinder.

3. A printing plate assembly according to claim 2, wherein a part of said non-magnetic sheet which overlaps said main body is bonded to an entire surface of said one end of said main body opposing to the outer surface of said magnet cylinder.

4. A printing plate assembly according to claim 1, wherein said magnetic piece is formed of a band-like member made of a ferromagnetic material.

5. A printing plate assembly according to claim 4, wherein a length of said magnetic piece in an axial direction of said magnet cylinder is set to be larger than a length of said non-magnetic sheet.

6. A printing plate assembly according to claim 1, said non-magnetic sheet is bonded to an under surface of said one end portion of said main body throughout an entire widthwise direction of said main body.

7. A printing plate for a magnet cylinder which has at least one magnet on an outer surface thereof, comprising:

a main body of the plate which main body is formed of a flexible thin plate-like magnetic material for magnetically mounting on an outer surface of the magnet cylinder;

a non-magnetic sheet which is formed from a flexible thin plate-like member and partially bonded to one end portion of said main body to project from the end portion of said main body; and a band-like magnetic piece configured to be magnetically attracted toward and retained against the outer surface of the magnet cylinder through said non-magnetic sheet to thereby hold said main body to the outer surface of the magnet cylinder, when said main body is mounted on the outer surface of the magnet cylinder, wherein said non-magnetic sheet is provided only to one end of said main body and bonded only to said one end of said main body throughout an entire widthwise direction of said main body, and said main body, non-magnetic sheet and band-like magnetic piece are configured so that when the plate is to be dismounted from the magnet cylinder, by removing said band-like magnetic piece from said non-magnetic sheet, only said non-magnetic sheet lifts away from the outer surface of the magnet cylinder in a state that said main body is magnetically held on the magnet cylinder.

* * * * *

UNITED STATES PATENT AND TRADEMARK OFFICE

CERTIFICATE OF CORRECTION

PATENT NO. : 8,720,336 B2
APPLICATION NO. : 11/726038
DATED : May 13, 2014
INVENTOR(S) : Mitsuhiko Sato and Masahiko Takahashi It is certified that error appears in the above-identified patent and that said Letters Patent is hereby corrected as shown below:

In the Claims

Column 10, Claim 1, line 38, please delete “both” and insert --body--.

Signed and Sealed this
Eighteenth Day of November, 2014

Michelle K. Lee

Michelle K. Lee
*Deputy Director of the United States Patent and Trademark Office*